US008196377B1

(12) United States Patent
Putty et al.

(10) Patent No.: US 8,196,377 B1
(45) Date of Patent: Jun. 12, 2012

(54) SAFETY RELEASE FOR RIDING HARNESS

(76) Inventors: William Barnes Putty, Helotes, TX (US); James D. Benner, Jr., San Antonio, TX (US)

( * ) Notice: Subject to any disclaimer, the term of this patent is extended or adjusted under 35 U.S.C. 154(b) by 41 days.

(21) Appl. No.: 12/927,020

(22) Filed: Nov. 4, 2010

Related U.S. Application Data

(60) Provisional application No. 61/280,462, filed on Nov. 4, 2009.

(51) Int. Cl.
*B68B 5/00* (2006.01)

(52) U.S. Cl. ..... 54/1; 54/69; 24/603

(58) Field of Classification Search ..... 54/1, 69; 119/772, 776, 777, 859, 865; 24/603
See application file for complete search history.

(56) References Cited

U.S. PATENT DOCUMENTS 3,505,979 A * 4/1970 Rosswag ..... 119/772
3,733,530 A * 5/1973 Labart et al. ..... 318/16
4,919,082 A * 4/1990 Tsai ..... 119/720
4,986,059 A * 1/1991 Boutilier ..... 54/2
5,359,756 A * 11/1994 Miyauchi et al. ..... 24/603
5,534,852 A * 7/1996 Schuett et al. ..... 340/573.1
5,771,668 A * 6/1998 Younger ..... 54/1
5,949,339 A * 9/1999 Ettinger et al. ..... 340/573.1
6,050,225 A * 4/2000 Stamps ..... 119/859
6,578,885 B1 * 6/2003 Tillman ..... 292/201
7,062,895 B1 * 6/2006 Sperie ..... 54/71
2005/0263106 A1 * 12/2005 Steinbacher ..... 119/858

* cited by examiner

*Primary Examiner* — Rob Swiatek
*Assistant Examiner* — Lisa Tsang
(74) *Attorney, Agent, or Firm* — Wayne J. Colton, Inc.

(57) ABSTRACT

A safety release for emergency separation from an animal of an affixed harness includes a structural body having formed integral therewith a mechanism for securing the body to a first portion of a riding harness, such as, for example, a bull rope, and a selectively releasable shackle assembly. The shackle assembly is structurally adapted for affixation to a second portion of the riding harness. The mechanism for securing the body to the riding harness comprises a preferably arcuate channel formed in a first, channel end of the body, the channel end of the body being generally opposite a shackle end. The shackle end is adapted to selective receive and secure the shackle assembly to the body.

10 Claims, 14 Drawing Sheets

SAFETY RELEASE FOR RIDING HARNESS

RELATED APPLICATION

This present application claims all available benefit under 35 U.S.C. §119(e) to U.S. provisional patent application Ser. No. 61/280,462 filed Nov. 4, 2009. By this reference, the full disclosure of U.S. provisional patent application Ser. No. 61/280,462, including the drawings, are incorporated herein as though now set forth in its entirety.

FIELD OF THE INVENTION

The present invention relates to sports safety. More particularly, the invention relates to a remotely actuable safety release for use in connection with a riding harness such as, for example, a bull rope as utilized in the sport of bull riding.

BACKGROUND OF THE INVENTION

Famously referred to by National Geographic as "the most dangerous eight seconds in sports," bull riding pits an athlete 20 one-on-one against a bull 24 weighing as much as 2000 pounds in a showdown so hazardous that one or two bull riders 20 per year lose their lives to the competition. Notwithstanding the ever present peril, however, and much to the excitement of nearly two million annual live event attendees and another 100 million annual television viewers, bull riders 20 are spurred on by the thrill of the action, and the desire to test their skills, tenacity and daring against the mighty bulls 24, to continue to participate in the sport. With the sport likely only to increase in fan popularity and rider participation, improvements in rider safety become ever more important.

To this end, promoters of bull riding have gone to great lengths to provide the bull riders 20 with additional protection from the bulls. For example, improved helmets and a specially designed protective vest 23 have greatly contributed to a reduced injury rate. Unfortunately, however, one danger that persists notwithstanding its often tragic consequences is the risk that the bull rider 20 will be unable to successfully free his or her riding hand 21 from the bull rope 29 during dismount, especially in the case of being bucked off from the bull 24. When such a "hang up" happens, the bull rider 20 is almost never able to reach the bull rope 29 with his or her free hand 22 and, as a result is completely dependent on the bullfighters or horsemen for what is very likely lifesaving assistance. Until the bullfighters and horsemen are able to reach the bull 24 and gain control over the bull rope 29, however, the bull rider 20 is in grave danger of being trampled by the bull 24 or slammed into the arena fence or bull chutes. In any of these situations, serious injury or death is a very probable result.

With the shortcomings of the prior art clearly in mind, it is therefore an overriding object of the present invention to provide a method and apparatus through which a harness may be quickly and reliably removed from an animal, removal therefrom being possible through remote control.

SUMMARY OF THE INVENTION

In accordance with the foregoing objects, the present invention—a, safety release for emergency separation from an animal of an affixed harness—generally comprises a structural body having formed integral therewith a means for securing the body to a first portion of a riding harness, such as, for example, a bull rope, and a selectively releasable shackle assembly. The shackle assembly is structurally adapted far affixation to a second portion of the riding harness. The means for securing the body to the riding harness comprises a preferably arcuate channel formed in a first, channel end of the body, the channel end of the body being generally opposite a shackle end. The shackle end is adapted to selectively receive and secure the shackle assembly to the body.

In the exemplary case of the safety release of the present invention being utilized in connection with a bull rope, the safety release is preferably interposed the bull rope about the bull's girth in the area of the bull's chest immediately behind the bull's front legs. In this manner, the safety release may be deployed for use without interference with normal use of the bull rope yet also may be utilized to reliably and immediately release the bull rope from about the girth of the bull in the case of a hang up or like safety hazard.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Figure 1:
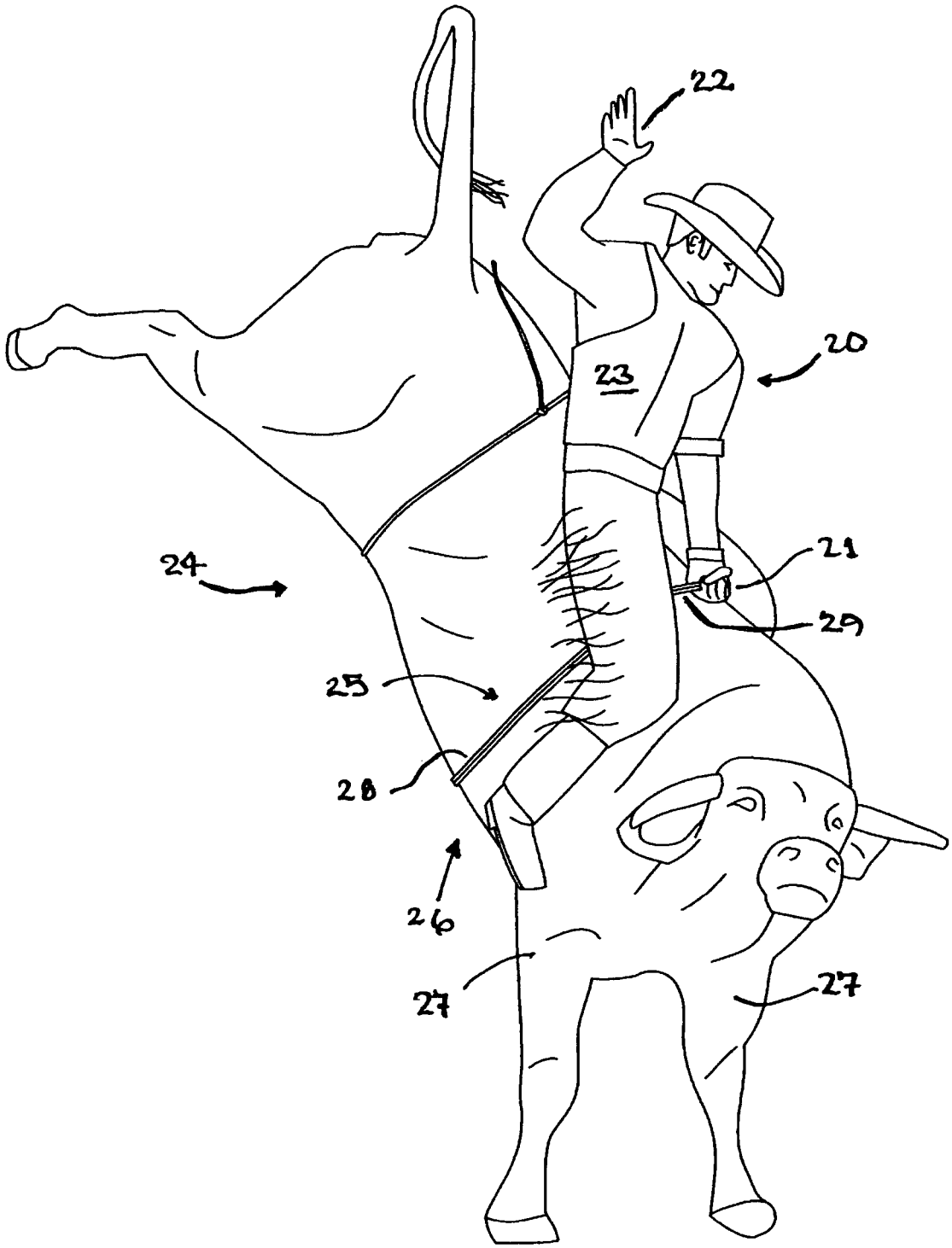
FIG. 1 shows, in a perspective view, a bull rider conventionally mounted atop a bull.
Figure 2:
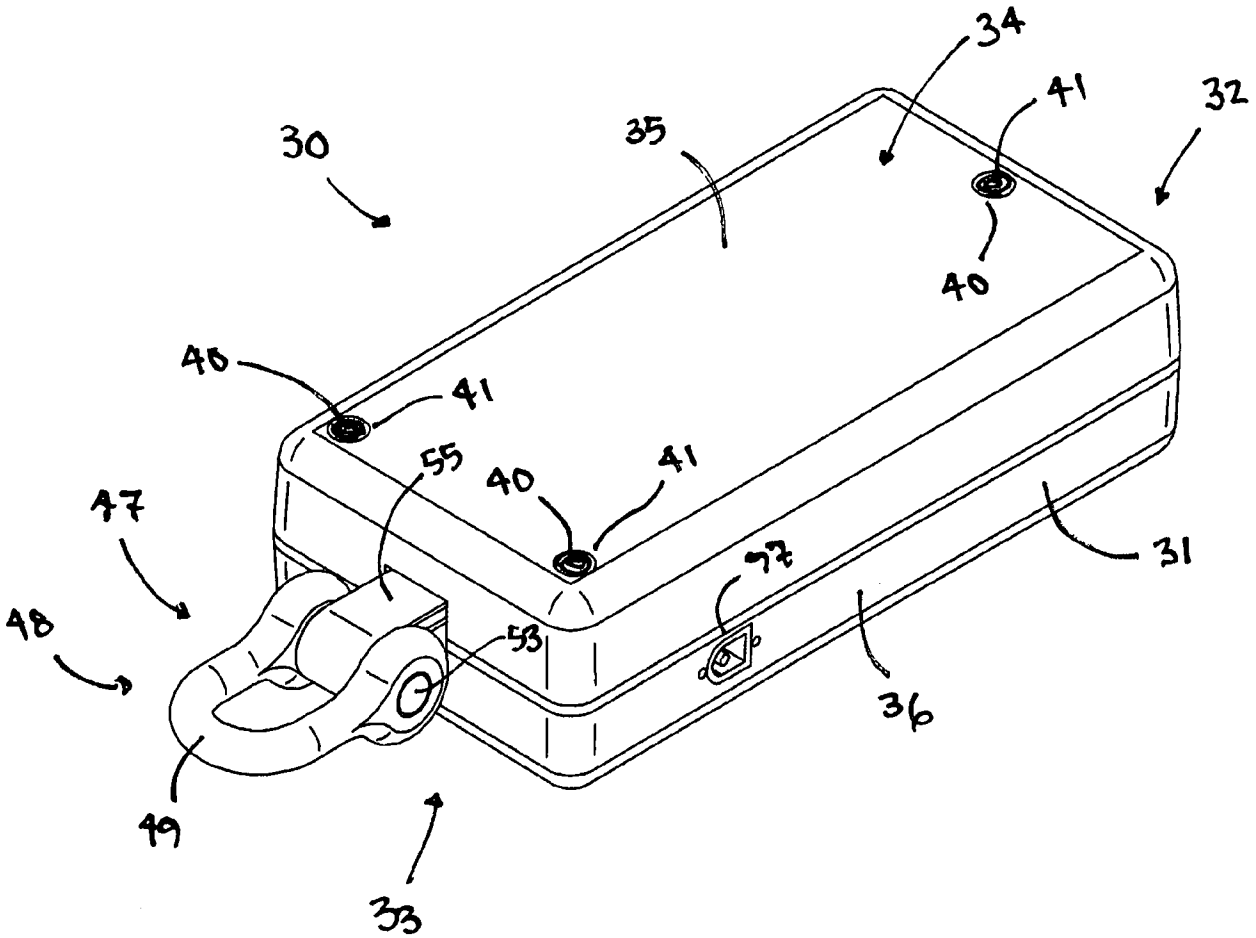
FIG. 2 shows, in a top perspective view, the preferred embodiment of the safety release of the present invention.
Figure 3:
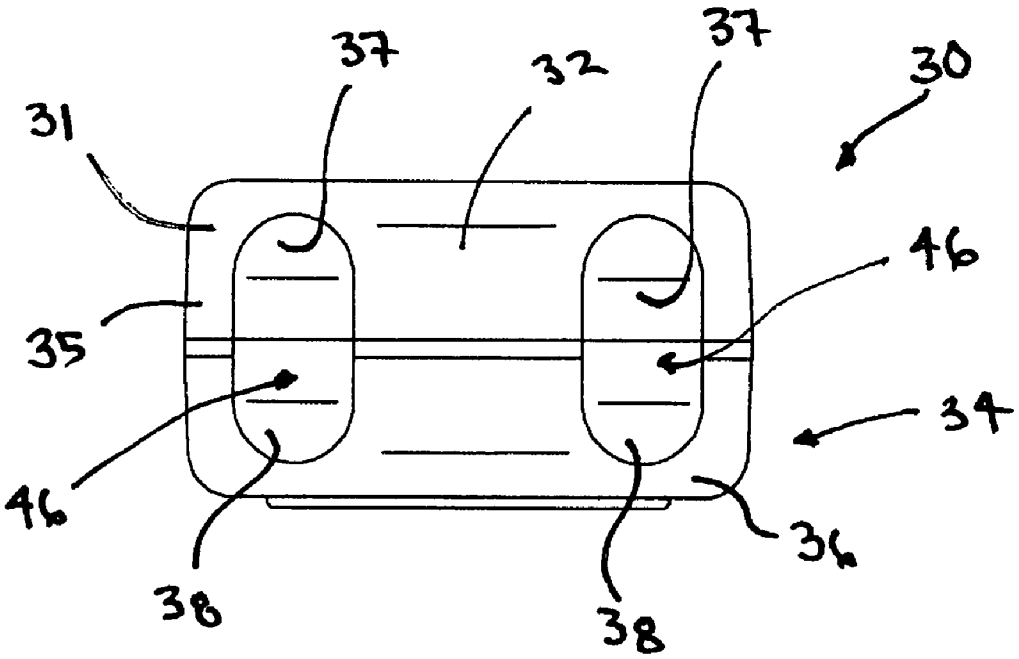
FIG. 3 shows, in a channel end elevational view, the safety release of FIG. 2.

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Referring now to the figures, the safety release 30 of the present invention is shown to generally comprise a structural body 31 having formed integral therewith a means for securing the body to a first portion of a riding harness 28, such as, for example, a bull rope 29, and a selectively releasable shackle assembly 47, wherein the shackle assembly 47 is structurally adapted for affixation to a second portion of the riding harness 28. In the exemplary embodiment of the present invention as now described, the means for securing the body 31 to the riding harness comprises a preferably arcuate channel 46 formed in a first, channel end 32 of the body 31 of the safety release 30, the channel end 32 of the body being generally opposite a shackle end 33 adapted to selectively receive and secure the shackle assembly 47. In the exemplary case of the safety release 30 of the present invention being utilized in connection with a bull rope 29, the safety release 30 is preferably interposed the bull rope 29 about the bull's girth in the area of the bull's chest 26 immediately behind the bull's front legs 27. In this manner, as will be better understood further herein, the safety release 30 may be deployed for use without interference with normal use of the bull rope yet also may be utilized to reliably and immediately release the bull rope 29 from about the girth 25 of the bull 24 in the case of a hang up or like safety hazard.

In order to provide structural integrity, the body 31 is preferably formed of aluminum, steel or like material. As shown in the figures, the preferred embodiment of the present invention comprises a structural base 38 formed of aluminum, steel or the like having securely affixed thereto a structural cap 37 of like construction. In the most preferred embodiment, however, the structural base 38 and structural cap 37 are further encased by a lower casing 36 and an upper casing 35, respectively, of polycarbonate or like material, which casings 35, 36 together thereby form an impact resistant housing 34 for the assembled safety release. In any case, those of ordinary skill in the art will recognize that the structural cap 38, whether encased or not, may be readily affixed to the structural base 38 utilizing conventional mounting hardware 40, such as, for example, cap screws 41 or the like, which may be inserted through the structural cap 37 and into threaded assembly holes 39 provided on the top side of the structural base 38.

As shown in the figures, the shackle assembly 47 of the present invention preferably comprises a shackle 48 adapted to be secured to the second portion of the riding harness 28 and a receiver pin 55 adapted to be releasably received by the body 31 of the safety release 30. As shown in the figures, the shackle 48 preferably comprises a clevis 49 having a first, preferably countersunk prong 50 and a second, preferably threaded prong 51. As shown in the figures, the shackle 48 as described may be readily affixed to the receiver pin 55 utilizing a conventional clevis pin 52 having, for example, a threaded end 53 opposite a screw head 54. To this end, the receiver pin 55 preferably comprises a yoke 63 with a lateral bore 64 therethrough, the lateral bore 64 being adapted to also receive the clevis pin 52 of the shackle 48.

Figure 4:
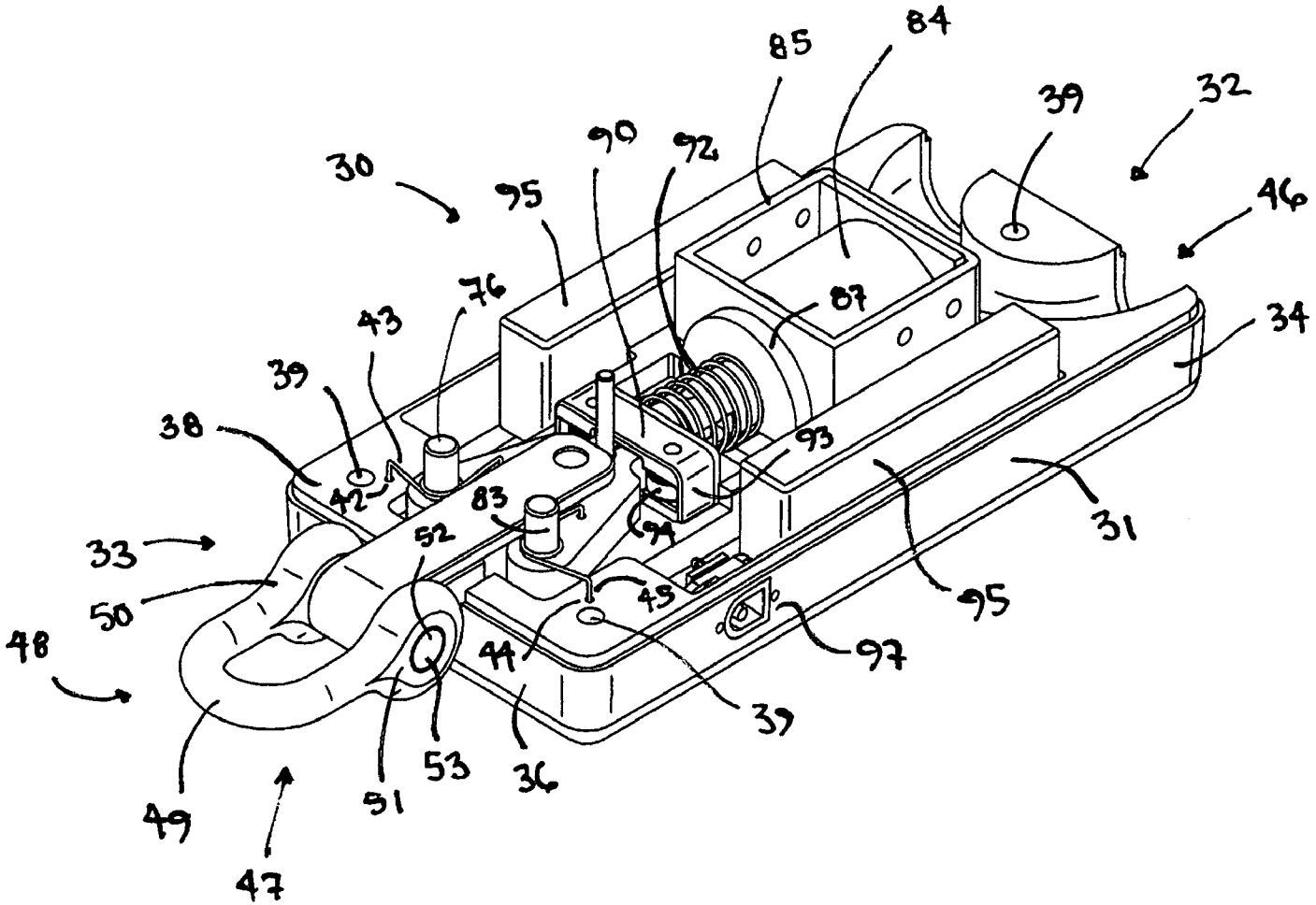
FIG. 4 shows, in a top perspective view, the safety release of FIG. 2 with its structural cap removed therefrom.
Figure 5:
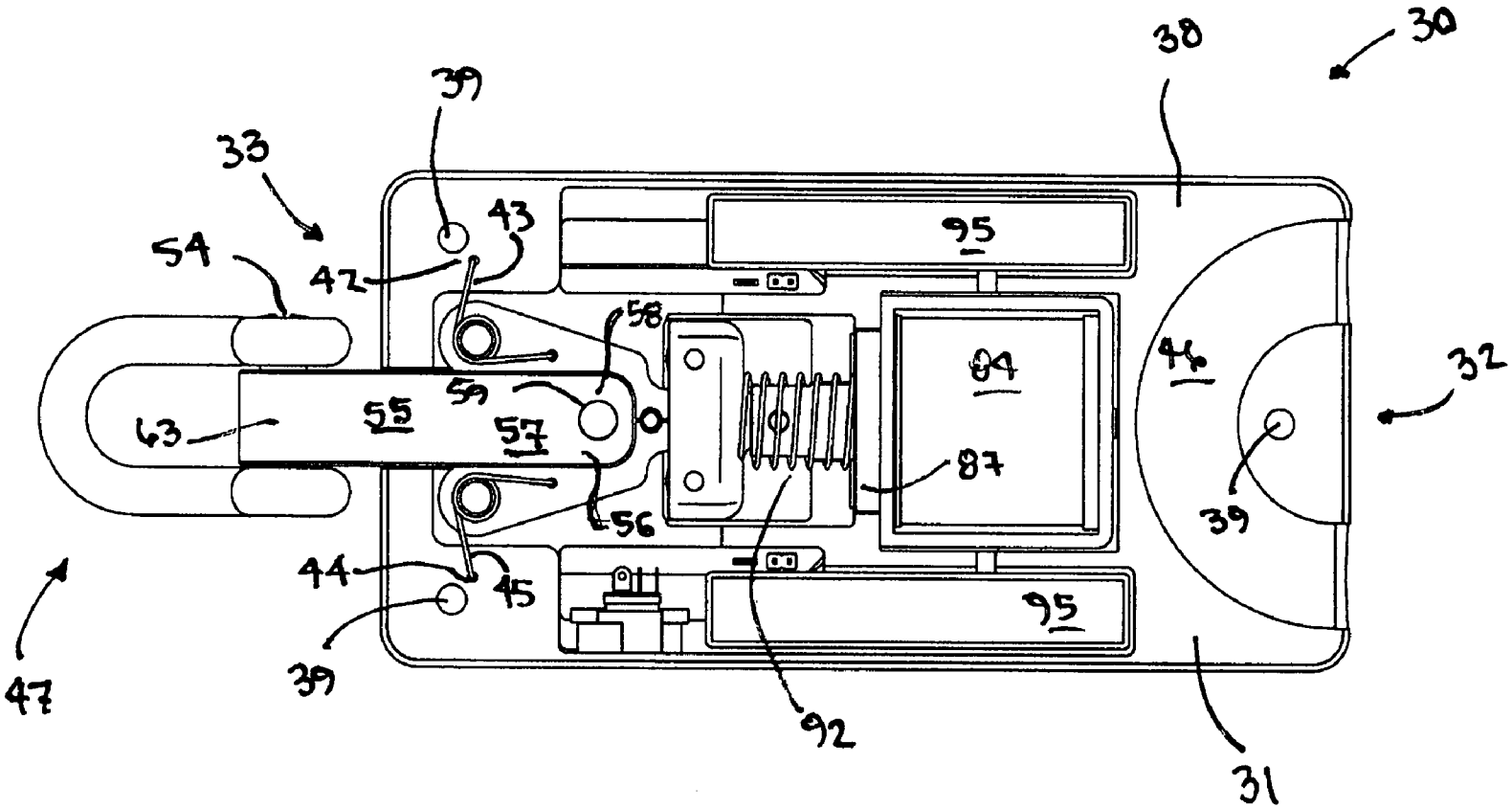
FIG. 5 shows, in a top plan view, the safety release of FIG. 2 configured as in FIG. 4.
Figure 6:
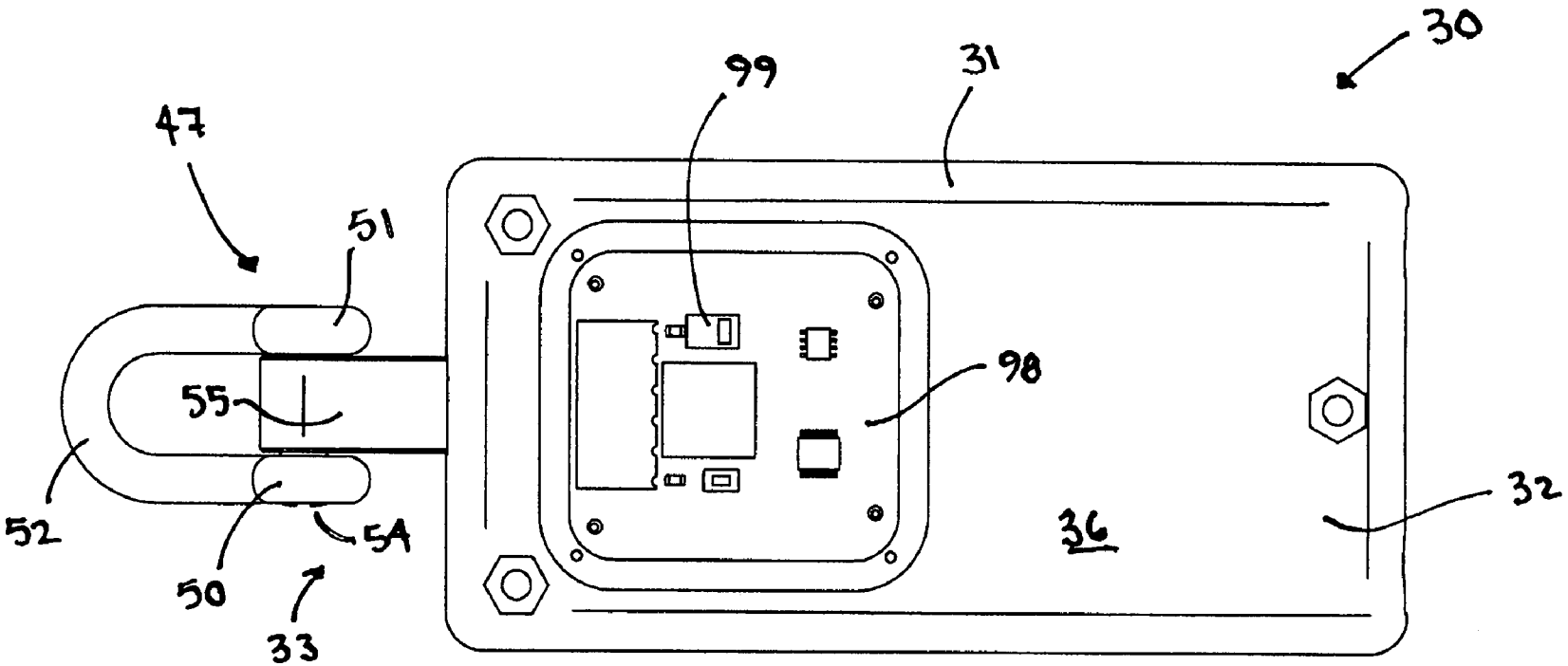
FIG. 6 shows, in a bottom plan view, the safety release of FIG. 2 with its electronics cover panel removed to expose a portion of the control circuit protected therein.
Figure 10:
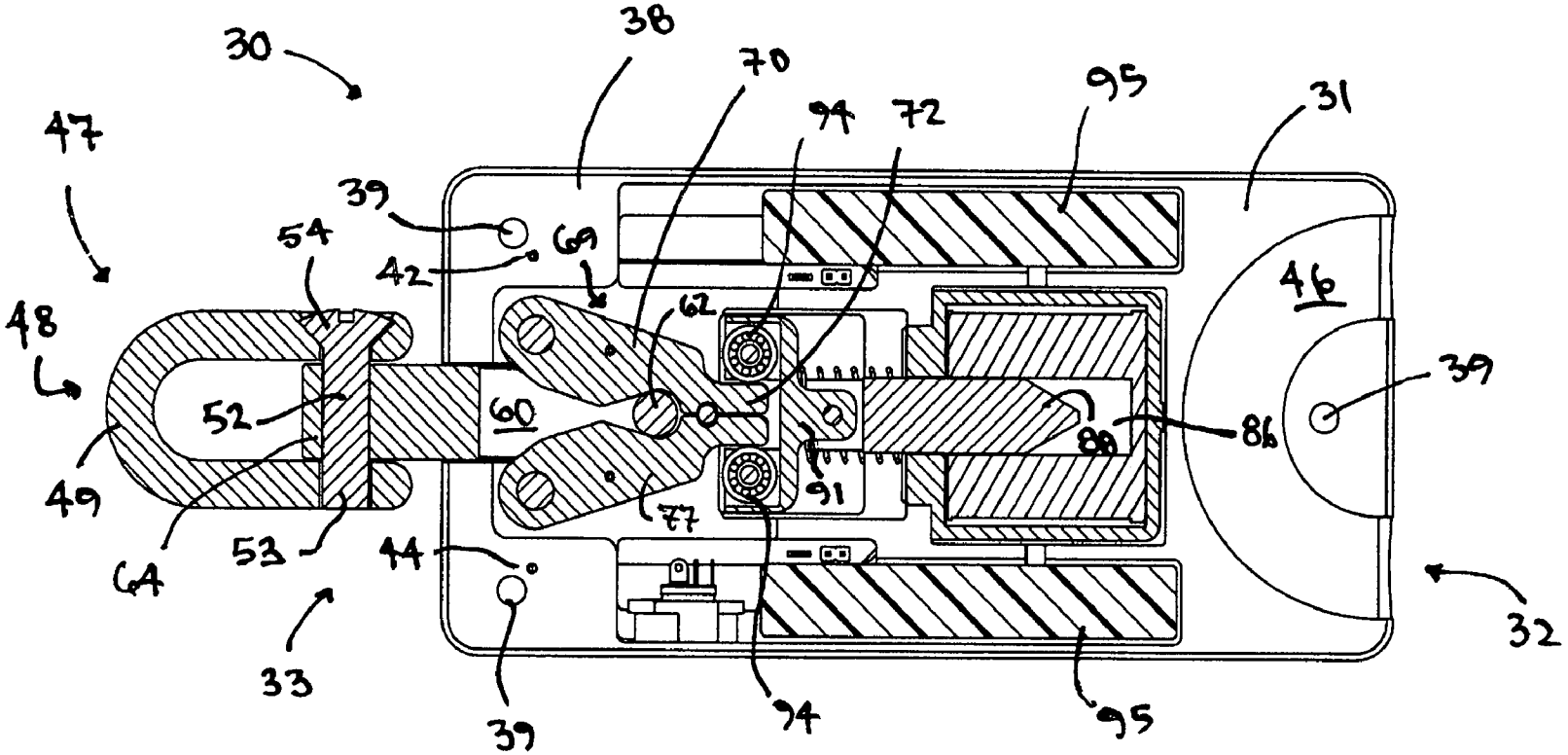
FIG. 10 shows, in a cross sectional view taken through cut line 10-10 of FIG. 9, the safety release of FIG. 2.
Figure 11:
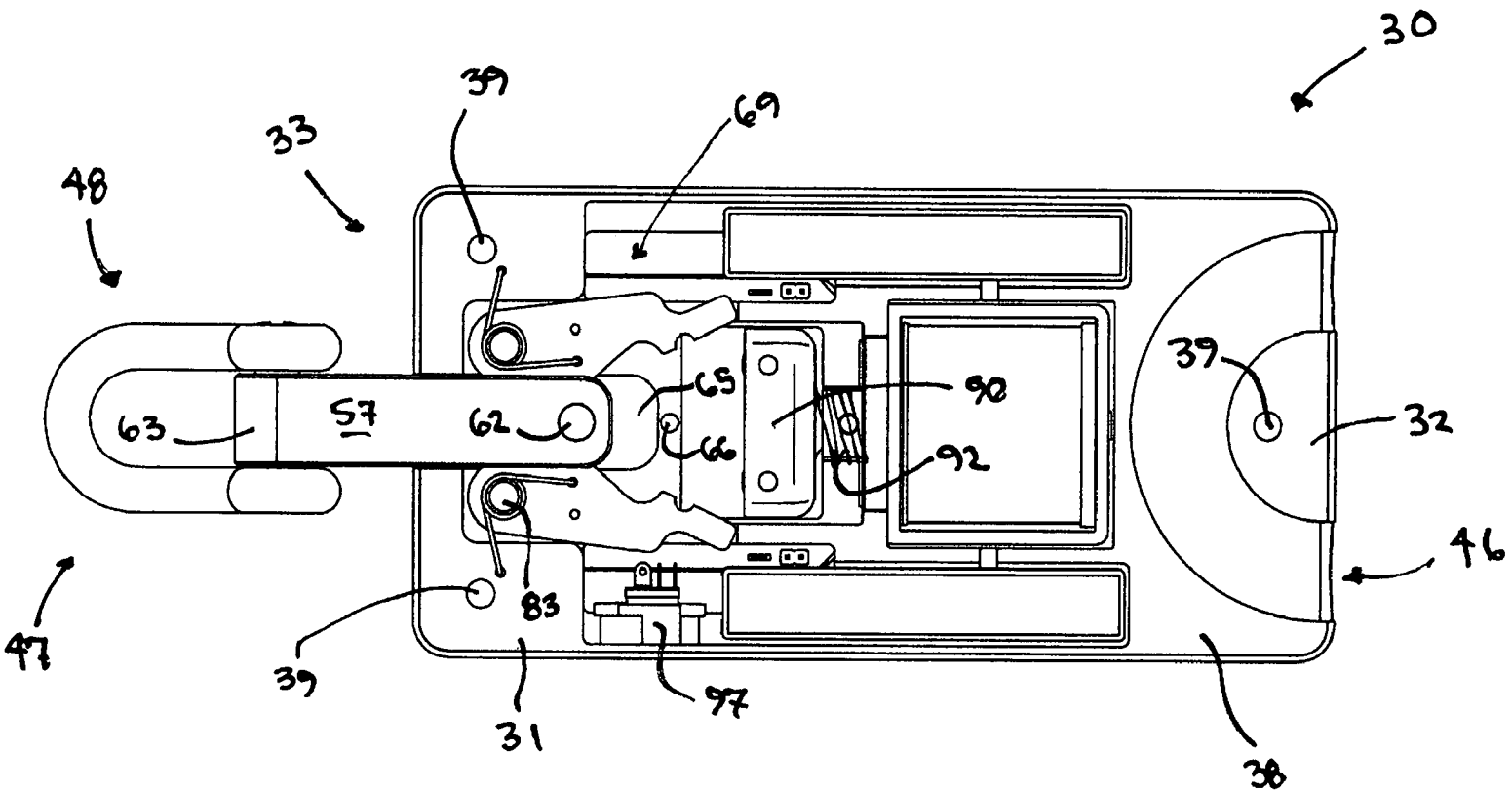
FIG. 11 shows, in a top plan view, the safety release of FIG. 2 with the structural cap removed therefrom and the shackle assembly partially removed therefrom.
Figure 12:
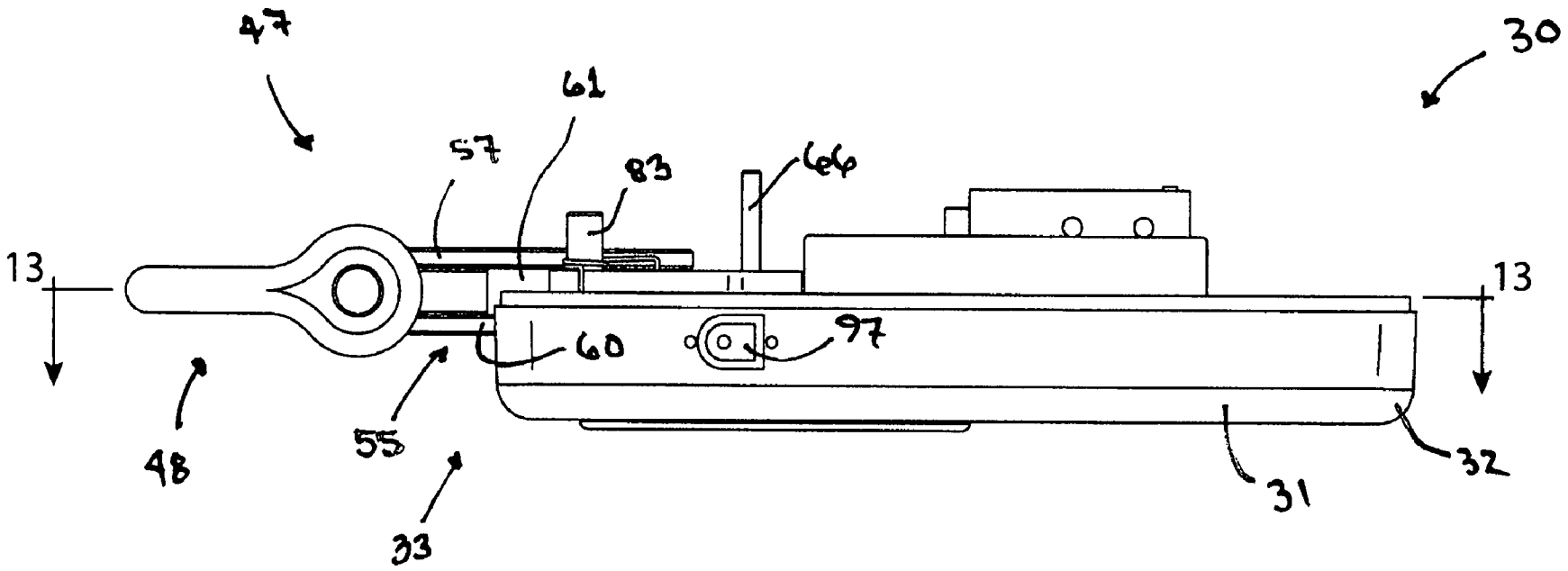
FIG. 12 shows, in a front side elevational view, the safety release of FIG. 2 as configured in FIG. 11.
Figure 13:
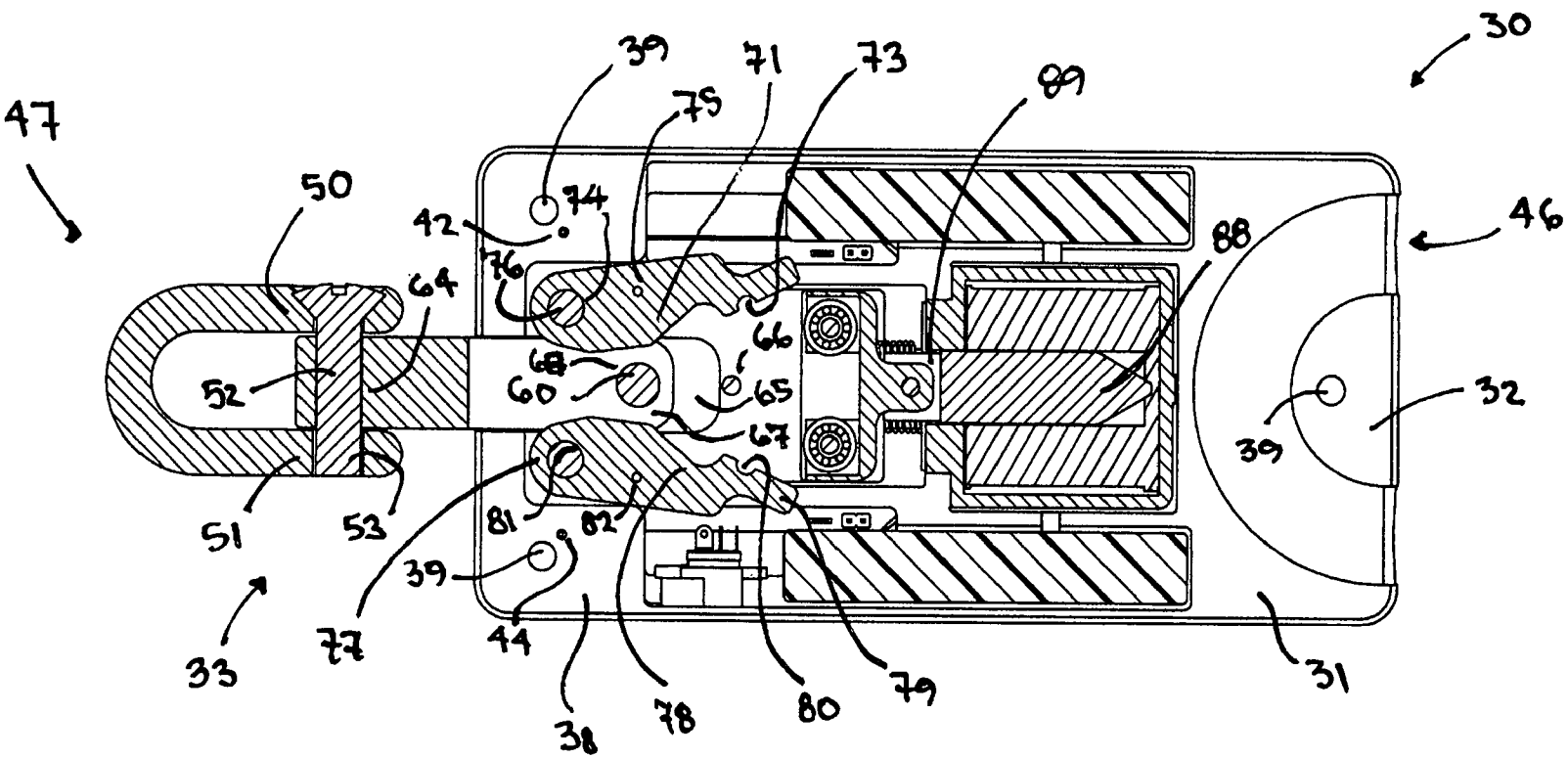
FIG. 13 shows, in a cross sectional view taken through cut line 13-13 of FIG. 12, the safety release of FIG. 12.

In a critical aspect of the present invention, however, as particular shown in FIGS. 4, 5 and 10, the shackle assembly 47 is releasably received by a latch mechanism 69 provided in connection with the body 31 of the safety release, the latch mechanism 69 being specifically adapted to ensure reliable release of the shackle assembly 47. In particular, the latch mechanism 69 of the present invention comprises a first jaw 70 and a second jaw 77, the first and second jaws 70, 77 being cooperatively adapted for readily releasable clamping engagement about a portion of the receiver pin 55. To this end, the receiver pin 55 is preferably formed to comprise a clevis 56 having an upper arm plate 57 and a lower arm plate 60, the distal ends 58, 67, respectively, of the arm plates 57, 60 each being additionally provided with a pin hole 59, 68, respectively. A latch pin 62 is press fit or otherwise securely provided between the pin holes 59, 68 to form the portion of the receiver pin 55 clamped by the latch mechanism 69. Additionally, and as will be better understood further herein, the described arrangement also results in a generally open intermediate space 61 being formed between the upper arm plate 57 and the lower arm plate 60 of the receiver pin 55, the resulting intermediate space 61 being necessary for the free operation of the latch mechanism 69. In any case, in order to ensure that the shackle assembly 47 is received stably within the body 31 of the safety release 30, the structural cap 37 and the structural base 38 of the body 31 are cooperatively adapted to form a receiver channel 65 conforming to the general size and shape of the receiver pin 55.

As shown in the figures, the first and second jaws 70, 77 of the latch mechanism 69 are each provided with a mounting hole 74, 81, respectively, through which the jaws 70, 77 are rotatably mounted to pivot pins 76, 83 upwardly affixed to the top surface of the structural base 38. In order to bias the first and second jaws 70, 77 one toward the other, a jaw spring 43, 45 is provided about each pivot pin 76, 83. In particular, a first jaw spring 73 is provided about the first pivot pin 76, one end of the first spring 43 being affixed to a hole 42 provided in the top surface of the structural base 38 and the opposite end of the first spring 43 being affixed to a hole 75 provided in the top surface of the first jaw 70. Likewise, a second jaw spring 45 is provided about the second pivot pin 83, one end of the second spring 45 being affixed to a hole 44 provided in the top surface of the structural base 38 and the opposite end of the second spring 45 being affixed to a hole 82 provided in the top surface of the second jaw 77. In order that the first and second jaws 70, 77 of the latch mechanism 69 may be cooperatively adapted for readily releasable clamping engagement about the latch pin 62 of the receiver pin 55, the first and second jaws 70, 77 of the latch mechanism 69 are each provided with an interior cam 71, 78, respectively, in order that the jaws 70, 77 may be readily deflected about the latch pin 62 during engagement or release of the shackle assembly 47.

As also shown in the figures, however, a cap 93 is provided to prevent such deflection except when desired for insertion or release of the receiver pin 55 to or from the body 31 of the safety release 30. In particular, the cap 93 is adapted to secure the jaws 70, 77 one to another by encasing a neck portion 72, 79 formed at the distal end of each jaw 70, 77. In order to ensure that the neck portions 72, 79 as shown will align precisely with the cap 93, it is also shown that an alignment notch 73, 80 formed on each jaw 70, 77 is adapted to engage with an alignment pin 66 upwardly affixed to the top surface of the structural base 38. In any case, the cap 93 is preferably provided as the distal end of a plunger 90, which plunger in turn is affixed to the armature 88 of a solenoid 84. In particular, as shown in the figures, the plunger comprises a neck 91 adapted to be interconnected with a slot 89 formed on the distal end of the armature 88 of the provided solenoid and is biased away from the solenoid 84, and toward the latch mechanism 47, by a compression spring 92 provided and positioned about the neck 91 of the plunger and between the shoulder 87 of the solenoid and the cap 93.

Figure 14:
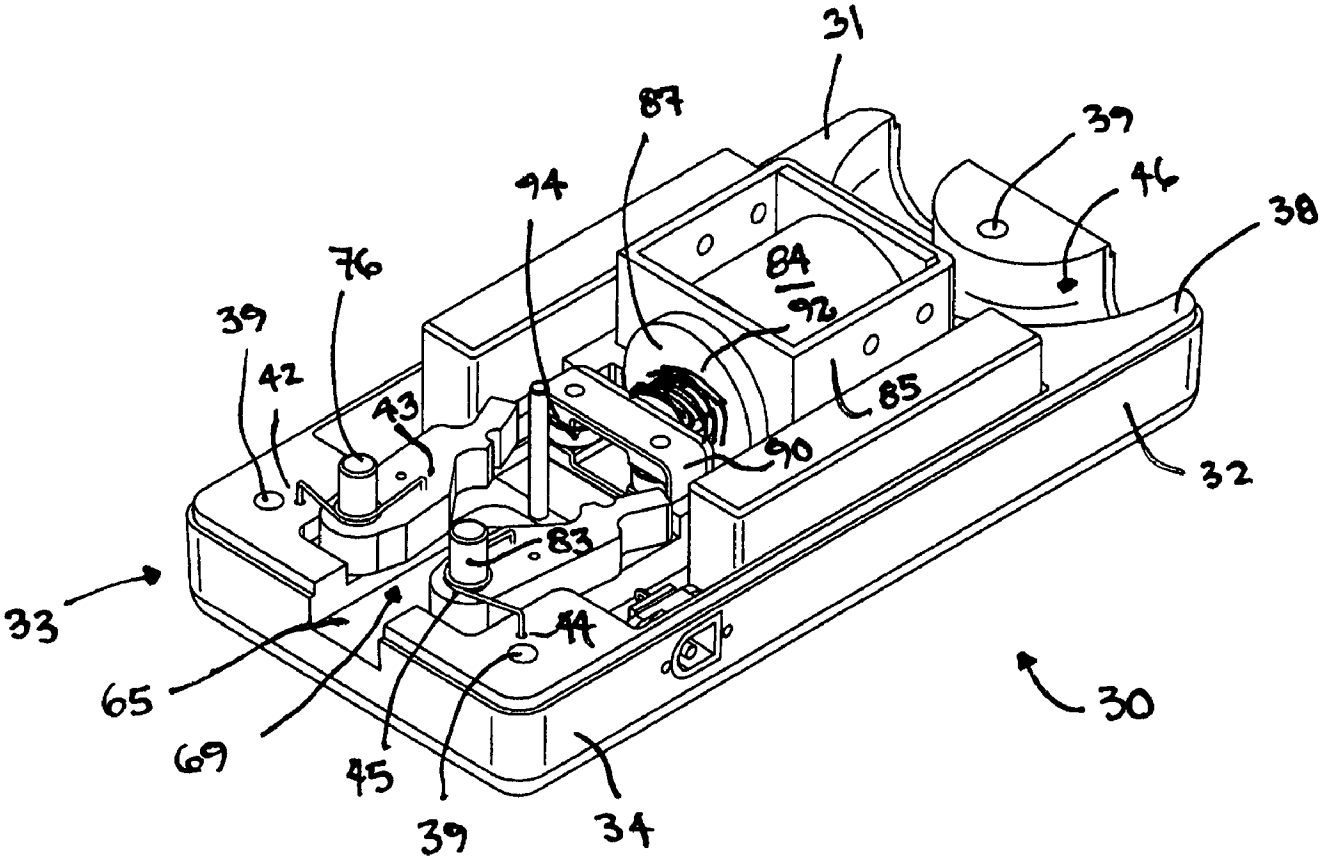
FIG. 14 shows, in a top perspective view, the safety release of FIG. 2 with the structural cap removed and the shackle assembly completely released therefrom.

To insert the receiver pin 55 to the body 31 or, most importantly, to quickly release the receiver pin 55 from the body 31, the solenoid 84, which is preferably held securely in place within the body 31 by being affixed within a provided solenoid housing 85, operates to selectively draw the armature 88 into the axial bore 86 formed within the solenoid 84, thereby drawing the plunger 90 against the action of the spring 92 and toward the solenoid 84 to release the cap 93 from about the neck portions 72, 79 of the jaws 70, 77 of the latch mechanism 69. The cap 93 thus drawn back, the jaws 70, 77 are then free to separate about the latch pin 62, whereafter the receiver pin 55 is completely free to slide clear of the body 31 of the safety release as particularly shown in FIG. 14. In an important aspect of the present invention, however, the cap 93 is most preferably provided with a plurality of radial bearings 94, such as, for example, unflanged ball or roller bearings, such that any chance that the neck portions 72, 79 may become lodged inside the cap 93 due to friction resulting from tension on the bull rope 29 is eliminated.

Figure 7:
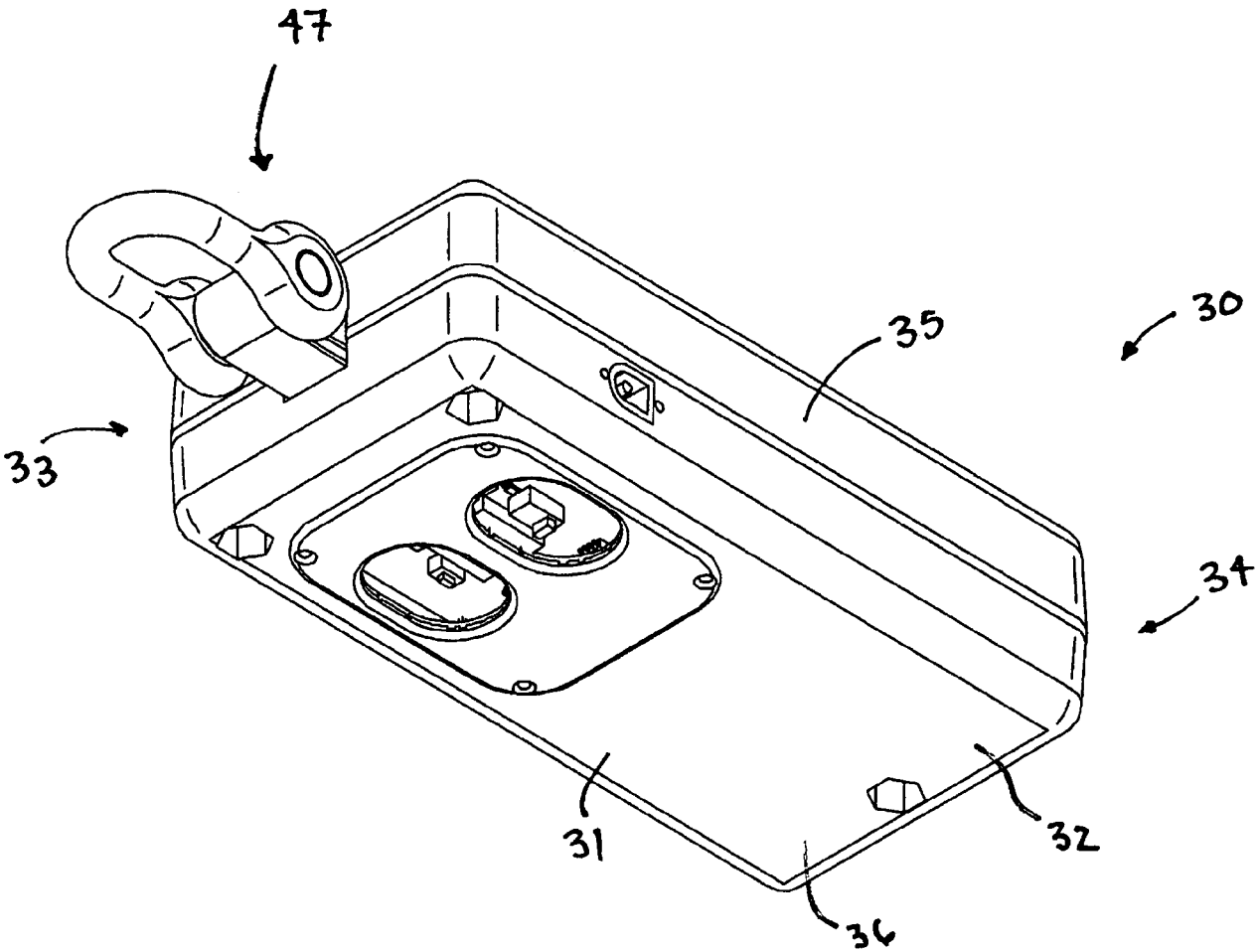
FIG. 7 shows, in a bottom perspective view, the safety release of FIG. 2.
Figure 8:
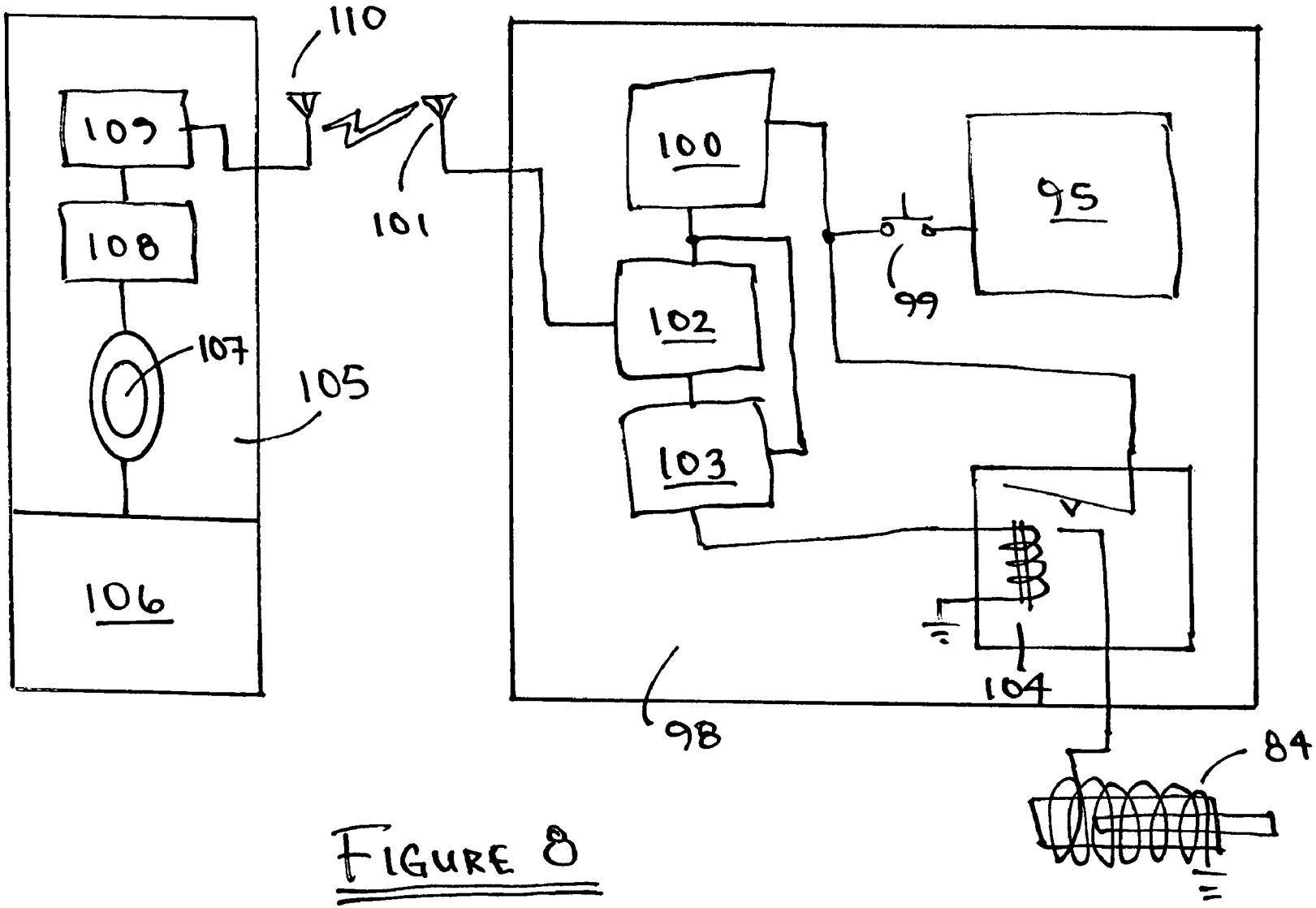
FIG. 8 shows, in a functional block diagram, details of the communications and control circuitry as implemented in the preferred embodiment of the present invention.
Figure 9:
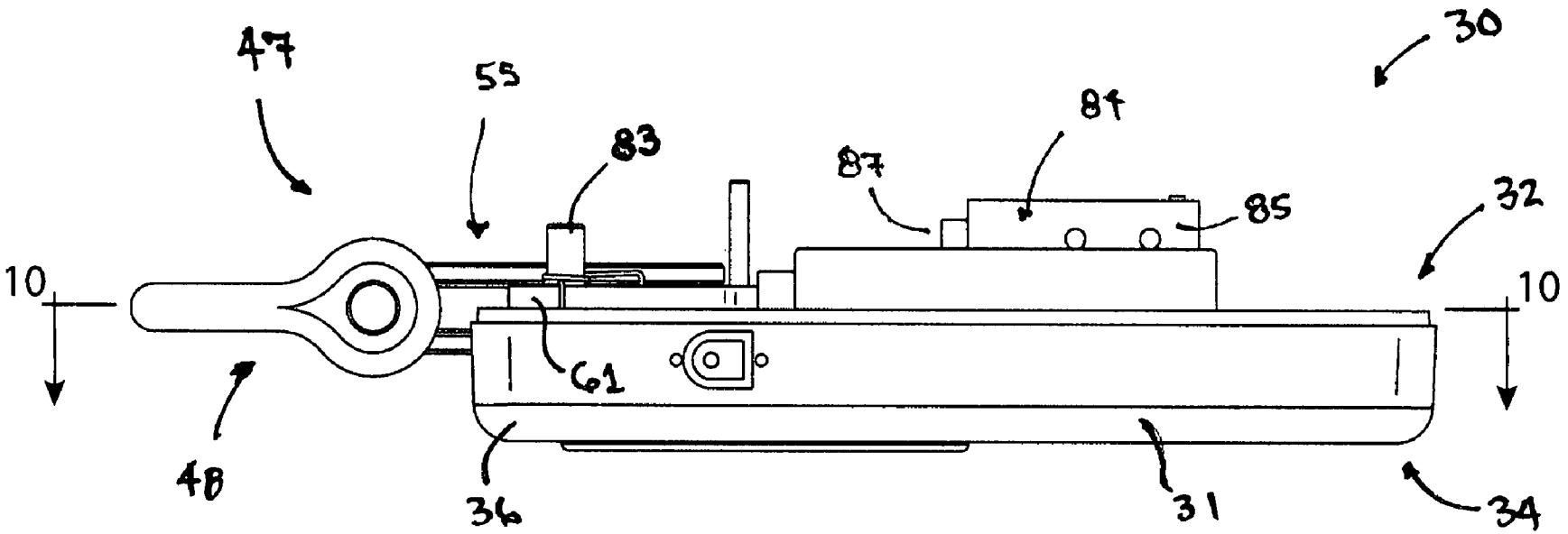
FIG. 9 shows, in a front elevational view, the safety release of FIG. 2 as configured in FIG. 4.

Finally, as particularly shown in FIGS. 7 and 8, the safety release 30 of the present invention further comprises a control circuit 98 embedded within the protective confines of the body 31 and a remote actuator 105. As shown in FIG. 8, the control circuit 98 includes a radio frequency receiver 102, with associated appropriate radio frequency antenna 101, for receiving a trigger signal generated by the remote actuator 105 and transmitted therefrom through a radio frequency transmitter 109 and associated antenna 110 provided therein. In the preferred embodiment of the present invention, the remote actuator 105 further comprises a preferably programmable signal encoder 108 and the control circuit further comprises a compatible preferably programmable signal decoder 103. In this manner, the actuation signal transmission may be secured to further ensure the safety of the bull rider 20 making use of the present invention. In any case, the remote actuator is preferably activated simply by pressing a simple push button switch 107 to apply power from a power source, such as a battery pack, to the actuator circuitry to generate the signal. The generated signal is then received through the receiver 102 at the control circuit, decoded as necessary and a voltage is presented to a high power relay 104. On activation of the relay 104, voltage is supplied to the solenoid 84 causing its operation as previously described for the instantaneous release from the body 31 of the safety release 30 of the shackle assembly 47, which in turn causes the instantaneous separation from the bull 24 of the bull rope 29. In this manner, a hung up bull rider 20 may be immediately freed.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, the remote actuator 105 may implement a voice recognition circuit in order that a bull rider with a microphone, such as may be provided within a safety helmet, may him or herself actuate the solenoid 84 even under duress.

Additionally, those of ordinary skill in the art will recognize that a charging circuit 96 and associated charging connector 97 may be provided in order that the control circuit 98 may be powered by permanently installed rechargeable batteries 99. Likewise, the control circuit will also preferably comprise a power switch 99, power on or other status indicators and the like. Still further, those of ordinary skill in the art will recognize that a voltage regulator 100 or other conditioning circuitry may be provided in connection with the control circuit 98 in order to prevent interference with the circuit's operation due to power spikes concomitant operation of the solenoid 84 or the like. In any case, because the scope of the present invention is much broader than any particular embodiment, the foregoing detailed description should not be construed as a limitation of the scope of the present invention, which is limited only by the claims appended hereto.

What is claimed is:

1. A safety release for emergency separation of an affixed harness from an animal, said safety release comprising:

a structural body having a first end and a second end, said first end being adapted for securement to a first portion of the affixed harness and said second end, generally opposite said first end, being provided with a latch mechanism;

a shackle assembly, said shackle assembly being adapted at a first end thereof for securement to a second portion of the affixed harness and comprising at a second end thereof, generally opposite said first end thereof, a receiver pin;

wherein:

said latch mechanism comprises a plurality of jaws adapted to releasably engage said receiver pin, said plurality of jaws being securable one to another by a cap adapted to encase a portion of each said jaw; and said cap is removable from portions of said jaws by actuation of a solenoid, said removal being facilitated by a provision within said cap of means for eliminating frictional lodging within said cap of said portions of said jaws;

a radio frequency receiver housed within said structural body, said radio frequency receiver being adapted to actuate said solenoid upon detection of a trigger signal; and a radio frequency transmitter, said radio frequency transmitter being adapted to generate said trigger signal at a location distant from said structural body.

2. The safety release for emergency separation of an affixed harness from an animal as recited in claim 1, wherein said radio frequency transmitter comprises a signal encoder and said radio frequency receiver comprises a compatible signal decoder.

3. The safety release for emergency separation of an affixed harness from an animal as recited in claim 2, wherein said signal encoder and said signal decoder are each programmable.

4. The safety release for emergency separation of an affixed harness from an animal as recited in claim 1, wherein said first end of said structural body comprises an arcuate channel for receiving therein the first portion of the affixed harness.

5. The safety release for emergency separation of an affixed harness from an animal as recited in claim 4, wherein said first end of said shackle assembly comprises a shackle for securing thereto the second portion of the affixed harness.

6. The safety release for emergency separation of an affixed harness from an animal as recited in claim 1, wherein said first end of said shackle assembly comprises a shackle for securing thereto the second portion of the affixed harness.

7. The safety release for emergency separation of an affixed harness from an animal as recited in claim 1, wherein said means for eliminating frictional lodging within said cap of said portions of said jaws comprises a plurality of radial bearings provided within said cap.

8. The safety release for emergency separation of an affixed harness from an animal as recited in claim 7, wherein said radial bearings comprise ball bearings.

9. The safety release for emergency separation of an affixed harness from an animal as recited in claim 7, wherein said radial bearings comprise roller bearings.

10. The safety release for emergency separation of an affixed harness from an animal as recited in claim 1, wherein said radio frequency transmitter is voice activated.

* * * * *